US006666276B1

(12) United States Patent
Yokley et al.

(10) Patent No.: US 6,666,276 B1
(45) Date of Patent: Dec. 23, 2003

(54) DOWNHOLE RADIAL SET PACKER ELEMENT

(75) Inventors: John M. Yokley, 5430 Hickory Village Dr., Kingwood, TX (US) 77345; Larry E. Reimert, Houston, TX (US)

(73) Assignee: John M. Yokley, Houston, TX (US)

( * ) Notice: Subject to any disclaimer, the term of this patent is extended or adjusted under 35 U.S.C. 154(b) by 115 days.

(21) Appl. No.: 10/083,320

(22) Filed: Oct. 19, 2001

(51) Int. Cl.[7] ..... E21B 33/00
(52) U.S. Cl. ..... 166/387; 166/134; 166/118
(58) Field of Search ..... 166/387, 382, 166/378, 134, 179, 118, 138, 191, 195

(56) References Cited

U.S. PATENT DOCUMENTS 4,416,472 A * 11/1983 Fowler et al. ..... 285/3
RE31,978 E * 9/1985 McStravick ..... 166/387
4,550,782 A * 11/1985 Lawson ..... 166/382
4,730,670 A * 3/1988 Kim ..... 166/134
4,745,972 A * 5/1988 Bell et al. ..... 277/338
4,900,041 A * 2/1990 Hopkins et al. ..... 277/328
5,586,601 A * 12/1996 Pringle ..... 166/212
5,829,524 A * 11/1998 Flanders et al. ..... 166/277

FOREIGN PATENT DOCUMENTS

EP 0447204 A2 * 9/1991

* cited by examiner

*Primary Examiner*—Frank Tsay
(74) *Attorney, Agent, or Firm*—Loren G. Helmreich

(57) ABSTRACT

A tool for use in a subterranean wellbore seals with a generally cylindrical interior surface of a tubular or another downhole tool. The tool includes a conveyance tubular 16 for positioning the tool at a selected location below the surface of the well, an annular seal assembly 10 disposed about the conveyance tubular, and a substantially conical wedge ring 14 having an outer surface configured to radially expand the annular seal assembly upon axial movement of the seal assembly relative to the wedge ring. The seal assembly 10 includes a metal framework having an annular base 18 and a plurality of metal ribs 30, 32, 34, 36 each extending radially outward from the base. A primary elastomeric seal 24 is positioned between the ribs 32, 34, while backup elastomeric seal body 22 is positioned between ribs 30 and 32 and backup seal body 26 is positioned between ribs 34 and 36.

25 Claims, 3 Drawing Sheets

DOWNHOLE RADIAL SET PACKER ELEMENT

FIELD OF THE INVENTION

The present invention relates to a radial set packer for sealing with a casing or other downhole cylindrical surface. More particularly, the present invention relates to a packer element which is configured with a primary seal and a backup seal, and may be part of a downhole tool including a conveyance tubular and a conical wedge ring. The packer element may be used for reliable sealing engagement between a liner hanger and a casing string.

BACKGROUND OF THE INVENTION

Packer elements or packers which are radially set by axial movement of the packer element relative to a conical wedge ring have been used for sealing in subterranean well bores. A conveyance tubular is conventionally provided for positioning the packer element at the desired position within the well bore, and an actuator causes the packer element to move axially with respect to a conical wedge ring and thereby expand into sealing engagement with the cylindrical surface to be sealed.

U.S. Pat. Nos. 4,757,860 and 5,076,356 disclose radial set packer elements which may be used in various applications, including a subsea wellhead. In a typical wellhead application, the packer element may need to expand in diameter approximately 0.030 inches in order to obtain a reliable seal with the polished bore.

U.S. Pat. Nos. 5,511,620 and 5,333,692 disclose packer elements intended for sealing between a liner hanger and a casing. More specifically, a conical member is moved axially with respect to the packer element to expand the packer element into engagement with a casing. That expansion may be significantly greater than the expansion of a packer element in a wellhead application due to the difference in diameter of the casing from the drift ID (smallest allowable ID for a particular size casing) to the maximum ID allowed by API for that size casing. The difference between this drift ID and the maximum ID for a particular size casing may thus be 0.300 inches or greater.

Several problems exist with the packer element disclosed in the '620 Patent. Because the seal element is stationary with respect to a movable conical element, the radially extending flanges or ribs of the seal element may not expand as desired into portions of the non-uniform diameter casing string to obtain reliable metal-to-metal sealing engagement. Also, the packer element does not always form a reliable metal-to-metal seal with the conical wedge ring, and the conical wedge ring similarly does not form a reliable metal-to-metal seal with the tool mandrel. Also, the elastomeric sealing portions of the seal element are not allowed to thermally expand in response to high temperature downhole conditions, and thus exert uncontrollable forces on the spaced apart metal radial flanges or ribs.

Other problems with prior art packer elements concern poor sealing reliability under high pressure conditions. The metal ribs may not reliably seal with the cylindrical surface, and the elastomeric portion of the seal assembly may not reliably seal over extended time periods. Some packer elements function reasonably well when high pressure is applied to one side of the packer element, but do not perform well when high fluid pressure is applied to the other side of the packer element.

The disadvantages of the prior art are overcome by the present invention, and an improved packer element and a tool including the improved packer element is hereinafter disclosed for reliably sealing between the packer mandrel and a downhole cylindrical surface.

SUMMARY OF THE INVENTION

The radial set annular packer element according to the present invention is positioned downhole by a conveyance tubular. The packer element may be moved by a setting tool from a reduced diameter run-in position to a set and expanded diameter position, such that the packer element engages a casing, a polished bore receptacle, or other downhole cylindrical surface in a well. If the cylindrical surface is a casing or other member which may be irregularly shaped, the packer element is preferably moved axially relative to a conical wedge ring or cone during the setting operation. The packer element is particularly well suited for reliably sealing against high pressure either from above or below the element, and includes a primary elastomeric seal and a secondary elastomeric seal, and a primary metallic seal and a secondary metallic seal. The metal ribs of the packer element are angled so that the primary elastomeric seal is pressed against a rib angled toward the high pressure, and the secondary elastomeric seal is similarly pressed against a rib angled toward the high pressure. The secondary elastomeric seal body acts on the primary rib to prevent the primary rib from becoming perpendicular with respect to the sealing surface, and thereby enhances the reliability of the seal.

It is an object of the present invention to provide an improved packer element which may be used in downhole applications for reliably sealing with a cylindrical surface. It is a feature of the present invention that the packer element is particularly well suited for sealing between a liner hanger and a casing under conditions where the casing may grow considerably in response to thermal and/or pressure expansion during downhole operations.

It is a related object of the invention to provide a downhole tool including a conveyance tubular, a conical wedge ring and an annular seal assembly or packer element according to the present invention.

It is a feature of the present invention that each of the primary and the backup metallic ribs of the sealing element are angled at least 15° with respect to a plane perpendicular to a central axis of the sealing element.

Another feature of the invention is that axially spaced metal protrusions provide a reliable metal-to-metal seal between the packer element and the cone, and also preferably between the cone and the mandrel or body interior of the cone.

Still another feature of the invention is that the elastomeric seal bodies of the packer element include specifically designed volumetric voids so that, after the seal bodies engage the surface, the elastomeric seal bodies will be compressed until the ends of the ribs engage the sealing surface. At this stage, the now smaller voids in the seal bodies allow for thermal expansion of each seal body between the metal ribs to minimize undesirable stress force on the ribs.

These and other objects, features, and advantages of the present invention will become apparent from the following detailed description, wherein reference is made to the figures in the accompanying drawings.

DETAILED DESCRIPTION OF THE PREFERRED EMBODIMENTS

Figure 1:
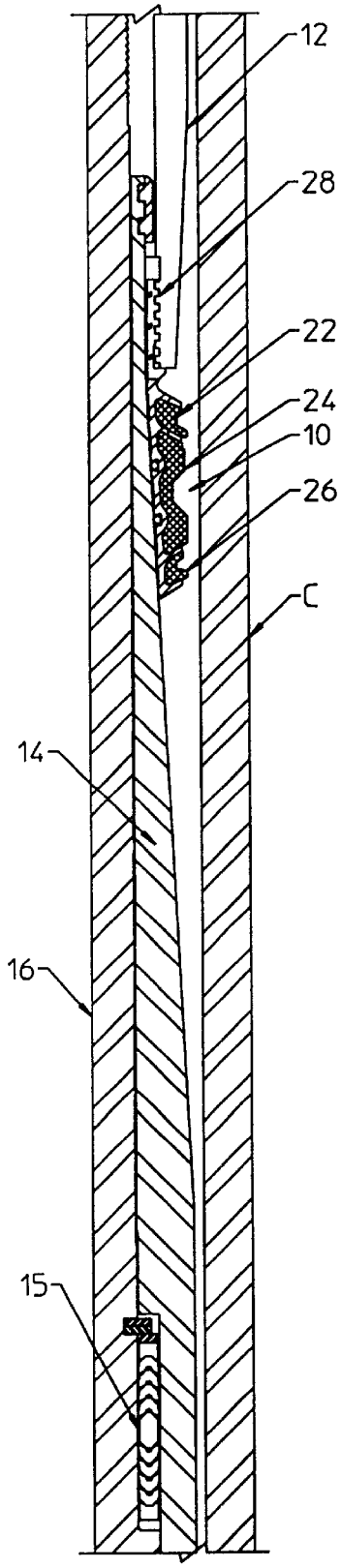
FIG. 1 is a half-sectional view of the seal element according to the present invention positioned at the lower end of a tie back receptacle for moving down along a cone and sealing with a casing.

FIG. 1 depicts an annular packer element 10 according to the present invention positioned at the lower end of a pusher sleeve 12 at the lower end of a tie back receptacle prior to sealing engagement with a casing C. Conventional grooves or threads 28 or similar connectors may be used to interconnect the packer element to the tie back receptacle. Axial movement of the packer sleeve 12 and thus the packer element 10 in response to the packer setting operation pushes the packer element downward relative to the tapered cone 14 to expand the seal element into sealing engagement with the casing. The cone 14 is in turn supported on a liner hanger body 16. In an environment where the packer element is not the top liner hanger seal, the packer element 10 may be supported on the end of a seal actuator which replaces the pusher sleeve 12, and the liner hanger body 16 may be a packer mandrel or other conveyance tubular for positioning the packer element in the well. In the FIG. 1 embodiment, the body 16 is thus part of the conveyance tubular which positions the packer element at a selected position within the well bore. The pusher sleeve of the tie back receptacle shown in FIG. 1 represents a lower portion of an actuator sleeve which urges the packer element from a reduced diameter run-in position to an expanded diameter activated or sealed position. The actuator sleeve may thus apply a selected axial force to the packer element to set the packer. The actuator may be selectively activated by various mechanisms, including set down weight or other manipulation of the conveyance tubular, and may include axial movement of a piston in response to fluid pressure, either with or without dropping plugs or balls to increase fluid pressure. Further details with respect to the use of the packer element in a liner hanger application are disclosed in U.S. application Ser. No. 60/292,049 filed May 18, 2001.

Figure 3:
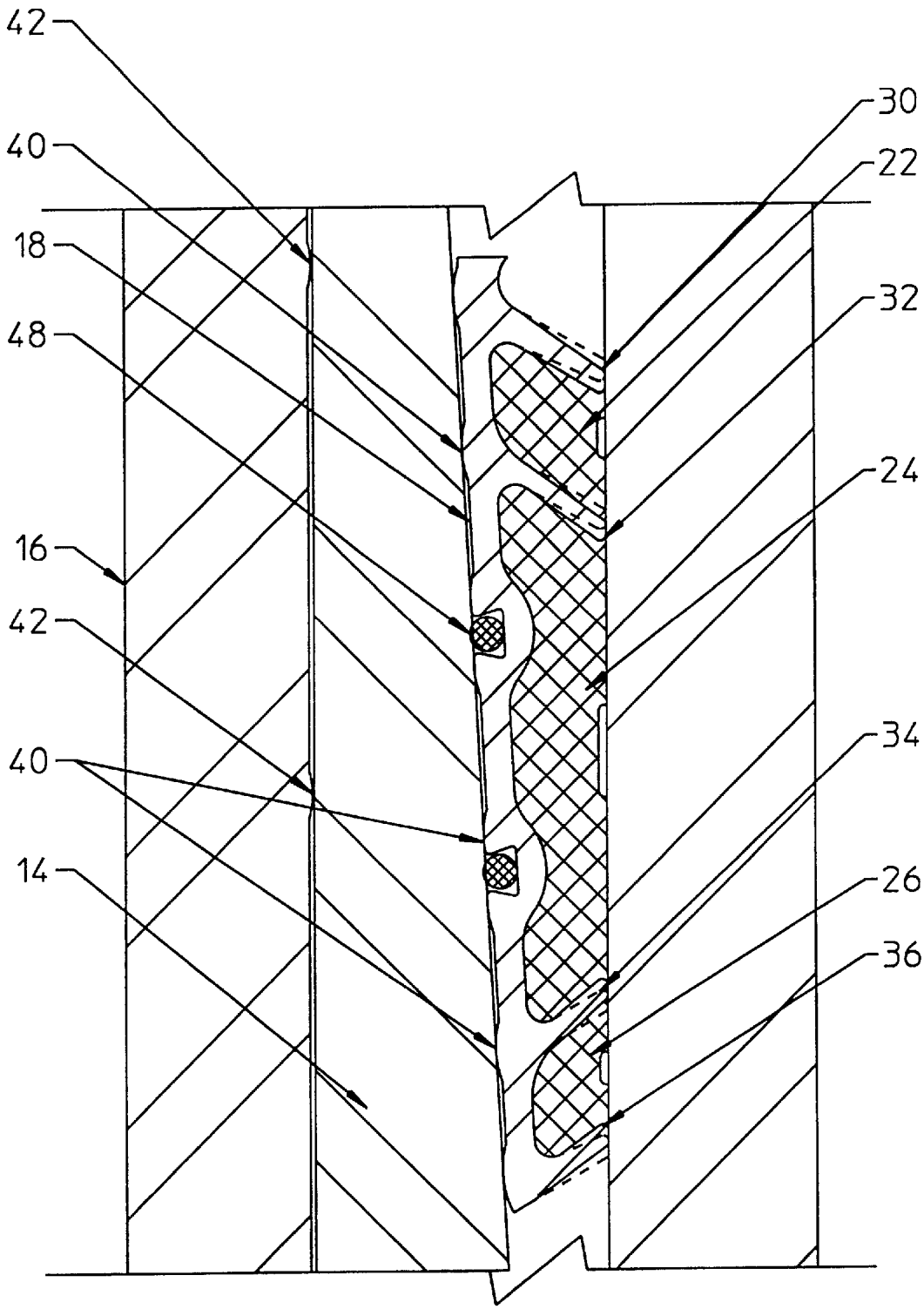
FIG. 3 is a cross-sectional view of the seal element in its final set position for sealing engagement between the cone and the casing.

The packer element as shown in FIG. 1 is in its original configuration in which the OD is reduced prior to being sealed with the casing. Packer element 10 is expandable so that it is moved downwardly over the stationary cone 14 to seal against the casing, as discussed below and as shown in FIG. 3. It is a feature of the invention that the packer element 10 be moved into reliable sealing engagement with the casing by a setting operation which includes moving the packer element 10 axially with respect to the packer cone 14, rather than moving the cone with respect to the stationary packer element. This setting operation forms a more reliable seal with the casing by allowing the ribs 20, during the setting operation, to flex or deform into the shape of the casing.

Figure 2:
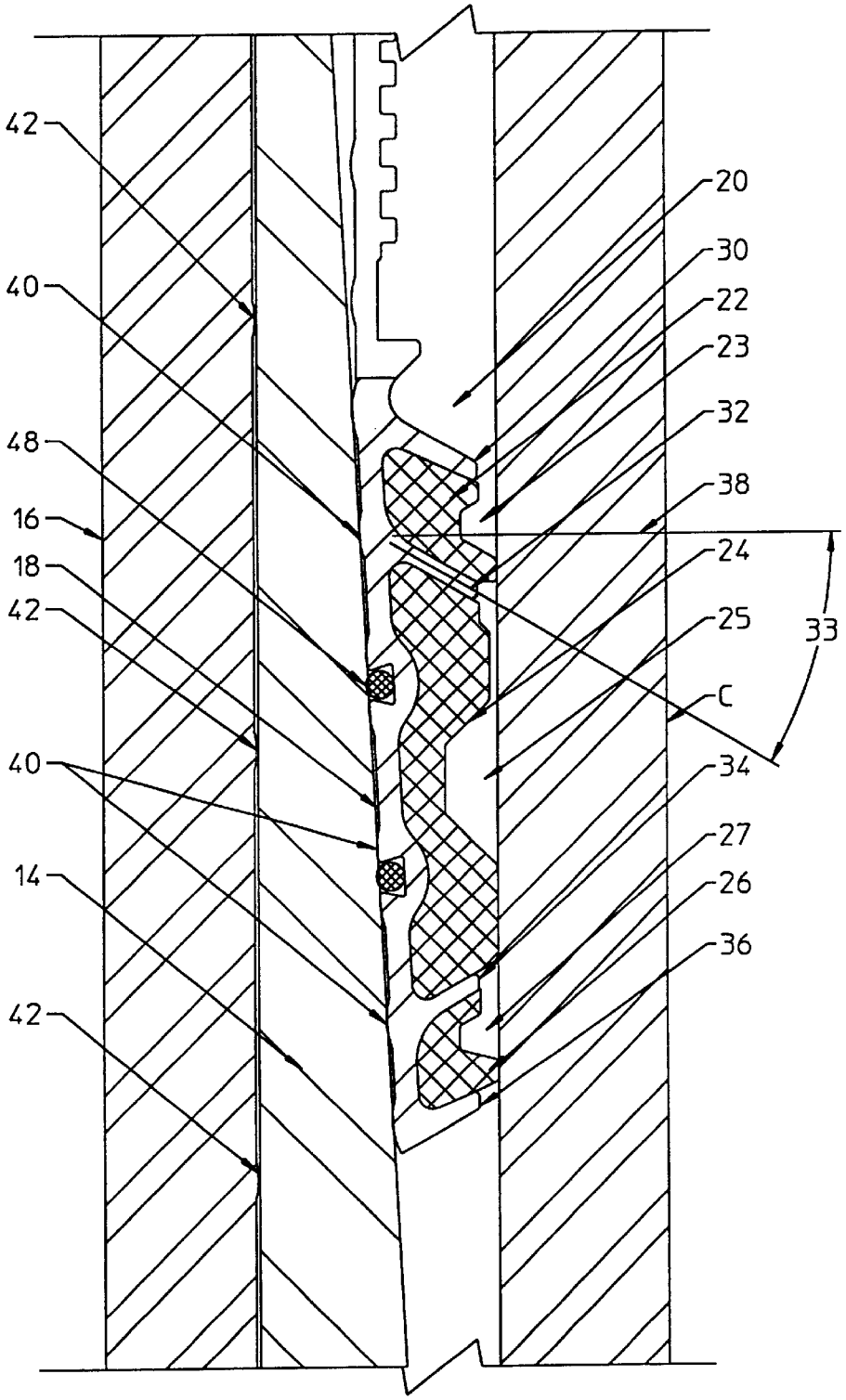
FIG. 2 is an enlarged view of a seal element shown in FIG. 1 positioned when the seal element initially engages the casing.

Referring to FIGS. 1 and 2, the packer element 10 comprises an inner metal body or base 18 for sliding over the conical wedge ring or cone 14 and annular flanges or ribs 20 which extend radially outwardly from the base 18 to engage the casing. The base 18 is relatively thin to facilitate radial expansion. The base 18 and the ribs 20 form a metal framework to support the rubber or other resilient and preferably elastomeric seal bodies. Rings of resilient seal bodies 22, 24 and 26 are provided between the ribs 20, and preferably the upper and lower sides of each seal body are in engagement with a respective rib. The body 18 and the ribs 20 are formed from material having sufficient ductility to expand into the annulus between the casing and the liner hanger. The metal portion of the packer element, namely the base 18 and the radially projecting ribs 20, is thus formed from material which is relatively soft compared to metals commonly associated with downhole tools. This allows the packer element to reliably expand into sealing engagement with the casing at a reduced setting load.

The radially projecting ribs 20 of the packer element are each substantially angled with respect to a plane perpendicular to a central axis of the packer element. More specifically, the centerline of each rib is angled in excess of 15°, and preferably about 30°, relative to the plane 38 perpendicular to the central axis of the packer element. Although the ribs may be slightly tapered to become thinner moving radially outward, the ribs preferably have a substantially uniform axial thickness. Rib 32 is shown in FIG. 2 at an angle 33 between the rib centerline and the plane 38. This feature allows each of the ribs 20 to expand substantially as the diameter of the casing varies or "grows", whether in response to internal pressure and/or thermal expansion. Because of the ability of the angled ribs 20 to flex, reliable metal-to-metal contact is maintained between the ends of the ribs and the casing, as shown in FIG. 3.

A particular feature of the invention is that the packer element 10 inherently forms both a primary seal with the casing and a secondary seal with the casing, with the secondary seal depending upon the direction of pressure. Also, the packer element may include both a primary and a backup elastomeric seal, and a primary and a backup metallic seal. Referring to FIG. 3, it should be understood that the downward inclination of the ribs 30 and 32 is such that relatively high fluid pressure above the packer element may pass by these ribs and the annular elastomeric upper seal body 22, so that the interior seal body 24, which constitutes a majority of the elastomeric seal area, forms the primary elastomeric seal against fluid flow. The term "fluid" as used herein includes gas, liquids and combinations of gas and liquid. Seal body 24 preferably engages the ribs 32, 34 and the base 18, and substantially fills the annular void between these surfaces. When fluid pressure is above the seal element 10, the lower seal body 26 positioned between ribs 34 and 36 forms a backup secondary elastomeric seal in the event the primary elastomeric seal were to leak. Similarly, when high fluid pressure is below the packer element, high pressure fluid would likely flow past the ribs 36 and 34, so that seal body 24 is the primary seal element. Seal body 22 between the ribs 30 and 32 thus becomes the secondary elastomeric seal element. The primary elastomeric seal element is thus pressed in an axial direction (generally along the central axis of either the conveyance tubular body or the casing) in response to pressurized fluid, against an inclined rib which is angled toward the high pressure, and the secondary elastomeric seal element is captured between two ribs each angled toward the high pressure side, so that the secondary seal element is also pressed in an axial direction against a rib angled in the direction of the high pressure. Most importantly, the backup seal, whether that be seal body 22 or 26, is captured between two ribs and thus minimizes the likelihood that the axially innermost rib 32 or 34 will flex outward to come in line with the plane 38, i.e., perpendicular to the wall of the casing. The material of the seal body 22 or 26 thus acts as a biasing force which tends to retain the rib 32 or 34 at a desired angle, which then supports the primary seal body 24 and prevents the rib 32 or 34 from becoming perpendicular to the wall of the casing C. Should the ribs flex past the point of being perpendicular to the casing wall, the packing element likely will lose its sealing integrity with the casing. The radial ribs 20 are thus vertically spaced from one another and act independently with respect to upward and downward directed pressure forces.

Packer element 10 also includes multiple metal sealing surfaces, namely the ends of each of the ribs 20, to form annular metal-to-metal seals with the casing. More particularly, these angled ribs are configured to keep a constant metal-to-metal seal with the casing even though the packing element may be subjected to variable fluid pressure and temperature cycles. Under high pressure, the two ribs adjacent the high pressure may flex toward the base 18 and thus not maintain sealing integrity. A primary metal seal is nevertheless formed by one of the axially innermost ribs 32 or 34 on the downstream side of elastomeric packer body 24, and a backup metal-to-metal seal is formed by the axially outermost rib 30 or 36 spaced axially farthest from the high pressure. High fluid pressure forces both the primary and secondary backup ribs to reduce the angle 33, thereby forming a tighter sealed engagement with the casing. The redundant or backup elastomeric seal 22 or 26 exerts a biasing force which tends to prevent the primary metal seal 32 or 34 from moving past the position where it is perpendicular to the wall of the casing.

Referring again to FIG. 2, each of the elastomeric seal bodies 22 or 24 and 26 is provided with a substantial void area 23, 25 and/or 27 to allow for compression of the elastomeric body and for thermal expansion so that, during both the final setting operation and during use downhole, the rubber-like material is not squeezed outwardly past the ends of the ribs, or squeezed to exert substantial forces on the ribs which will alter the flexing of the ribs. Preferably the void area between the ends of the ribs and the base of the sealing element is such that at least about 5% to 10% thermal expansion of elastomeric material may occur. This 5% to 10% void area thus allows for thermal expansion of each elastomeric resilient seal, thereby avoiding the creation of additional forces to act on the ribs 20. Each of the elastomeric seal bodies thus preferably includes voids that allow each resilient seal body to compress between the metal ribs without over-stressing or buckling the ribs. These voids will thus be substantially filled due to compression of the resilient sealing material, and will become substantially filled, as shown in FIG. 3, due to compression of the seal bodies and thermal expansion of the resilient seal bodies. The stress level on each of the elastomeric seals may therefore remain substantially constant with varying thermal cycles in the well bore.

As shown in FIG. 3, the elastomeric seal bodies have been compressed to reduce the void area, leaving only a small void volume for additional thermal expansion. The void area is preferably designed to be from 5 to 10% of the volume of the resilient seal bodies once each seal body is in its compressed position with the ends of the ribs engaging the casing, but prior to thermal expansion.

FIG. 3 depicts the packer element 10 according to the present invention in sealed engagement with the casing C, and at a temperature wherein the elastomeric material has already expanded to fill most of the void area discussed above. FIG. 3 also shows the flexing or bending of these ribs from the run in position as shown in dashed lines to the sealing position as shown in the solid lines. The inclination of the ribs, i.e., angle 33 as shown in FIG. 2, is thus increased during the packer setting operation. The ribs 30 and 32 at the upper end of the packer element 10 are angled downwardly, and the ribs 34 and 36 at the lower end of the packer element are angled upwardly. As explained above, the centerline of each rib is angled at least 15° with respect to the plane 38 perpendicular to the central axis of element 10 prior to setting, i.e. when of a reduced diameter as shown in FIG. 1.

The base 18 of the packer seal includes a plurality of inwardly projecting protrusions 40. These annular protrusions or beads on the packer element provide a reliable metal-to-metal sealing engagement with the packer cone 14. These protrusions provide high stress points to form a reliable metal-to-metal seal. Similar protrusions 42 on the packer mandrel to provide metal-to-metal sealing engagement between the packer mandrel 16 and the packer cone 14. Accordingly, the seal of the present invention operates in conjunction with the packer cone to obtain a complete metal-to-metal seal between the packer mandrel and the packer cone, between the packer cone and the seal element, and between the seal element and the casing. The multiple seal protrusions or beads 40 form axially spaced metal-to-metal seals between the base 18 of the sealing element 10 and the tapered cone 14, while protrusions 42 seal between the cone 14 and the packer body or other conveyance tubular 16. These metal-to-metal seals are energized as the packer seal is set, and preferably include multiple redundant annular metal-to-metal seals. Alternately, one or both of the radially inner and intermediate metal-to-metal seals could be formed by annular protrusions on the packer cone for sealing with either or both the packer element base 18 and the packer mandrel 16.

The resilient elastomeric seals 48 on the ID of the seal bore 18 may be backup seals, since the spaced apart metal protrusions 40 form the metal-to-metal seal between the packing element and the cone once the packer element is fully set. Another elastomeric seal, such as a V packing 15, provides an elastomeric backup seal between the cone 14 and the body 16. These metal protrusions 40 on the ID of the element 10 are axially in line with (laterally substantially opposite) the area where the ribs 20 seal against the casing. The interface between the casing and the metal ribs 20 of the packing element 10 thus force the metal seal protrusions 40 into tight metal-to-metal sealing contact with the cone 14. The protrusions 42 on the body 16 are similarly axially in line with the element 10. The metal-to-metal seals between the packer element and the cone are preferably provided on the packer element, since its axial position relative to the cone when in the set position may vary with the well conditions.

With the desired setting force applied to the packer element 10, the packer element will be pushed down the ramp of a cone 14 so that the ribs 20 come into metal-to-metal engagement with the casing. Metal seal protrusions 40 and 42 between the packing element 10 and the cone 14 and between the body 16 and the cone 14 are in contact, but have not been energized. When the setting pressure is increased, the ribs on the packing element may be flexed inward to a position in solid lines in FIG. 3. This high setting force will compress the seal bodies between the ribs and cause the outer diameter of each seal body into tight sealing engagement with the casing. This high setting force will also cause the metal protrusions 40 along the ID of the seal element 10 and the metal protrusions 42 along the OD of the mandrel 16 to form a reliable metal-to-metal seal with the cone 14. Under this load, these metal protrusions form high localized stress at the point the protrusions engage the cone to achieve a reliable metal-to-metal seal. The metal protrusions which provide the desired metal-to-metal seals between the body or mandrel 16 and the cone 14 could be provided on either the outer generally cylindrical surface of body 16 or the inner generally cylindrical surface of cone 14. A reliable fluid pressure tight barrier, which may be both a liquid barrier and a gas barrier, is thus formed with high reliability under various temperatures, pressures and sealing longevity conditions, due to the combination of the elastomeric and metal seals. After the sealing element comes into contact with the casing, the BOP preventer rams may be closed around the drill pipe (or other conveyance tubular) and fluid pressure may be applied to the annulus to pressure assist the setting of the packer element.

The sealing element of the present invention is well suited for use in a liner hanger for sealing between the packer mandrel of the liner hanger and the casing. The initial set down weight on the seal element 10 will thus force the seal element down the cone 14 and into contact with the casing C. Initially, the seal material which is radially outward of the ends of the ribs 20 will be compressed to occupy much of the void area in the seal bodies. Once the elastomeric bodies have been deformed so that the ends of the ribs engage the casing, the remaining void area may be from 5% to 10% of the volume of each seal body, assuming there has been no significant expansion of the seal bodies due to thermal expansion. If the seal bodies experience high thermal expansion prior to a setting operation, the void area will be reduced by compression of the seal bodies.

During well operations, the pressure may cause the casing to expand in diameter and, this expansion will cause the ribs to expand with the casing, so that the position of the ribs with respect to the expanded casing may return to the configuration as shown in dashed lines in FIG. 3. The ability of the ribs to "grow" in diameter with the expanding casing keeps the ends of the ribs in reliable metal-to-metal contact with the casing as the well goes through pressure and temperature cycles. When pressure is released and the casing shrinks, the ribs may return to the solid line configuration as shown in FIG. 3.

The seal element 10 of the present invention is thus ideally suited for applications in which high pressure may be applied from either direction to the seal element, since the seal element inherently provides both a primary seal and a secondary seal, with each elastomeric seal being supported in a direction to resist axial movement in response to the high pressure by a rib which is angled in the direction of the high pressure, and which allows flexing to conform to the casing. The rib on each side of the primary seal body is supported by the secondary seal body, which biases the rib toward the high pressure.

In the case of a liner hanger, the liner hanger running tool conventionally includes the actuator which provides the compressive force to the packer element 10 to set the packer. In other applications where the seal element is used, an actuator may be used for applying the compressive force to move the seal from a run in or radially reduced position to a sealing or radially expanded position. The actuator may be hydraulically powered or may use mechanical setting operations. Thereafter, a retainer keeps the seal element in sealing contact with the casing, after the running tool is returned to the surface, by preventing or limiting axial movement of the packer element when fluid pressure is applied.

The sealing element of the present invention may be used in various applications in a well bore having a tubular disposed therein, wherein a packer mandrel or other conveyance tubular is positioned within the well bore to position the packer element at a selected location. The packer element is disposed about the conveyance tubular and includes a plurality of elastomeric seal bodies for sealing engagement with the well bore tubular, and a plurality of metal ribs which separate the elastomeric seal bodies, with the rib ends intended for metal-to-metal sealing engagement with the tubular. The packer element may be run into the well in a configuration similar to that shown in FIG. 1 in which the sealing element has a reduced diameter, and the packer element deformed radially outward into sealing engagement with the well bore tubular as it moves relative to a conical wedge ring, until the packer element reaches the final set position, as shown in FIG. 3. The radial set sealing element of the present invention may thus be used for various types of downhole tools. Additional back-up secondary metal ribs could be provided, as well as additional back-up elastomeric bodies engaging these additional ribs.

Various types of conveyance tubulars may be used for positioning the packer element at a selected location below the surface of the well. The substantially conical wedge ring or cone may have various constructions with a generally outer conical surface configured to radially expand the annular seal assembly or packer upon axial movement of the packer element relative to the wedge ring, due either upon axial movement of the packer element relative to the stationary wedge ring or axial movement of the wedge ring relative to the stationary packer element. In a preferred embodiment, the seal assembly includes an upper elastomeric seal body, a primary elastomeric seal body, and a lower elastomeric seal body. While each of the upper and lower seal bodies ideally provide the backup elastomeric seal in the event the primary elastomeric seal were to leak, it is an important function of the upper seal body 22 and the lower seal body 26 to provide a desired biasing force against the respective rib 32 or 34. These elastomeric seal bodies thus function as biasing members between the axially outermost rib and the adjacent inner rib to exert a force which prevents the inner rib from flexing beyond a predetermined stage. For example, the lower seal body 26 engages both the inner rib 34 and the outer rib 36, and exerts an upward biasing force to prevent rib 34 from moving downward past a position where it is perpendicular to the wall of the casing. At the same time, the lower seal body 26 exerts a downward biasing force which tends to increase the downward flexing to the outer rib 36 when the inner rib 34 flexes downward in response to high pressure above the packer element.

In addition to the primary metal-to-metal seal, the secondary metal-to-metal seal, the primary elastomeric seal and the secondary elastomeric seal, additional sets of metal-to-metal and elastomeric seals could be provided in the packer element. Elastomeric bodies which are configured other than shown herein may thus be used for this purpose. Various types of plastic materials in various configurations may provide the desired biasing force, and ideally also a secondary resilient seal. Alternatively, a wave spring or other metallic material biasing member may be used instead of or in cooperation with the elastomeric bodies 22 and 26.

Preferably each of the metal ribs of the packer element as disclosed herein are annular members with the outermost surface of each rib, when in the run-in position, being substantially the same radial spacing from a central axis of the tool for reliable sealing engagement with the surface to be sealed. In other embodiments, one or more of the ribs could include radial notches so that the rib would not form a complete annular metal-to-metal seal, which then could be provided by the elastomeric seal, although then the complete annular metal seal would not be obtained. Preferably a plurality of axially spaced protrusions are provided for metal-to-metal sealing engagement between the packer element and the cone, and between the cone and the conveyance tubular. In other applications, a single annular protrusion may be sufficient to form the desired metal-to-metal sealing function.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed:

1. A downhole tool for use in a subterranean well to seal with generally cylindrical interior surface of a tubular or another downhole tool, the tool comprising:

a conveyance tubular for positioning the tool at a selected location below the surface of the well;

an annular seal assembly disposed about the conveyance tubular, the seal assembly having a reduced diameter run-in position and an expanded sealing position;

a wedge ring having a substantially conical outer surface configured to radially expand the annular seal assembly upon axial movement of the annular seal assembly relative to the wedge ring such that the seal assembly is expanded from its run-in position to its expanded sealing position wherein the seal assembly is in sealing engagement with the generally cylindrical interior surface; and the annular seal assembly including a metal framework having a radially inward annular base and a plurality of metal ribs each extending radially outward from the base, the metal framework including an upper downwardly angled primary seal metal rib for sealing pressure below the seal assembly, a lower upwardly angled primary seal metal rib for sealing pressure above the seal assembly, a primary elastomeric seal in a cavity radially outward from the base and axially between the upper primary seal metal rib and the lower primary seal metal rib, an upper downwardly angled secondary seal metal rib spaced axially above the upper primary seal metal rib, and a lower upwardly angled secondary seal metal rib spaced axially below the lower primary seal metal rib.

2. The downhole tool as defined in claim 1, further comprising:

an upper biasing member between the upper primary seal metal rib and the upper secondary seal metal rib for exerting a downward biasing force on the upper primary seal metal rib in response to high fluid pressure below the seal assembly, and a lower biasing member spaced between the lower primary seal metal rib and the lower secondary seal metal rib for exerting an upward force on the lower primary seal metal rib in response to high fluid pressure above the seal assembly.

3. The downhole tool as defined in claim 1, wherein an outer surface of each of the upper primary seal metal rib, the lower primary seal metal rib, the upper secondary seal metal rib, and the lower secondary metal rib is configured for forming an annular metal-to-metal seal with a generally cylindrical interior surface.

4. The downhole tool as defined in claim 1, wherein said conveyance tubular supports the wedge ring generally stationary while the seal assembly moves axially with respect to the stationary wedge ring.

5. The downhole tool as defined in claim 1, wherein the conveyance tubular supports the seal assembly generally stationary while the wedge ring moves axially with respect to the stationary seal assembly.

6. The downhole tool as defined in claim 1, wherein the seal assembly seals with an interior surface of a downhole tubular.

7. The downhole tool as defined in claim 1, wherein the primary elastomeric seal includes a void area when the primary elastomeric seal is moved into sealing engagement with the cylindrical surface, such that the primary elastomeric seal may thermally expand to fill at least part of the void area in response to elevated downhole temperatures.

8. The downhole tool as defined in claim 1, wherein each of the downwardly angled primary seal metal rib and the upwardly angled primary seal metal rib is inclined while in the run-in position at an angle of at least 15° with respect to a plane perpendicular to a central axis of the cylindrical interior surface.

9. The downhole tool as defined in claim 8, wherein each of the downwardly angled secondary metal rib and the upwardly angled secondary metal rib is inclined while in the run-in position at an angle of at least 15° with respect to a plane perpendicular to a central axis of the cylindrical interior surface.

10. The downhole tool as defined in claim 9, further comprising:

one or more annular metal protrusions on one of an outer surface of a conveyance tubular and an inner surface of the wedge ring to form a metal-to-metal seal between the wedge ring and the conveyance tubular.

11. The downhole tool as defined in claim 10, further comprising:

one or more annular elastomeric sealing members carried by one of the conical wedge ring and the conveyance tubular for forming an elastomeric seal between the conveyance tubular and the wedge ring.

12. The downhole tool as defined in claim 1, further comprising:

one or more axially spaced protrusions on a radially inner surface of the annular base of the metal framework each for metal-to-metal sealing engagement with the conical outer surface of the wedge ring.

13. The downhole tool as defined in claim 12, further comprising:

one or more annular elastomeric sealing members for sealing between the base of the metal framework and the conical outer surface of the wedge ring.

14. A tool for use in a subterranean well to seal with a generally cylindrical interior surface of a tubular or another downhole tool, the tool comprising:

a wedge ring having a substantially conical outer surface configured to radially expand an annular seal assembly upon axial movement of the annular seal assembly relative to the wedge ring such that the seal assembly is expanded from its run-in position to its expanded sealing position wherein the seal assembly is in sealing engagement with the generally cylindrical interior surface; and an annular seal assembly having a reduced diameter run-in position and an expanded sealing position, the seal assembly including a metal framework having a radially inward annular base and a plurality of metal ribs each extending radially outward from the base, the metal framework including an upper downwardly angled primary seal metal rib for sealing pressure below the seal assembly, a lower upwardly angled primary seal metal rib for sealing pressure above the seal assembly, a primary elastomeric seal in a cavity radially outward from the base and axially between the upper primary seal metal rib and the lower primary seal metal rib, an upper downwardly angled secondary seal metal rib spaced axially above the upper primary seal metal rib, and a lower upwardly angled secondary seal metal rib spaced axially below the lower primary seal metal rib.

15. The downhole tool as defined in claim 14, further comprising:

an upper secondary elastomeric seal between the upper primary seal metal rib and the upper secondary seal metal rib, and a lower secondary elastomeric seal spaced between the lower primary seal metal rib and the lower secondary seal metal rib.

16. A downhole tool as defined in claim 14, wherein an outer surface of each of the upper primary seal metal rib, the lower primary seal metal rib, the upper secondary seal metal rib, and the lower secondary metal rib is configured for forming an annular metal-to-metal seal with a generally cylindrical interior surface.

17. The downhole tool as defined in claim 14, wherein each of the downwardly angled primary seal metal rib, the upwardly angled primary seal metal rib, the downwardly angled secondary seal metal rib and the upwardly angled secondary seal metal rib is inclined while in the run-in position at an angle of at least 15° with respect to a plane perpendicular to a central axis of the cylindrical interior surface.

18. A method of forming a downhole seal with a generally cylindrical interior surface of a tubular or another downhole tool, the method comprising:

providing an annular seal assembly disposed about a conveyance tubular, the seal assembly having a reduced diameter run-in position and an expanded position, the seal assembly including a metal framework having a radially inward annular base and a plurality of metal ribs each extending radially outward from the base, the metal framework including an upper downwardly angled primary seal metal rib for sealing pressure below the seal assembly, a lower upwardly angled primary seal metal rib for sealing pressure above the seal assembly, a primary elastomeric seal in a cavity radially outward from the base and axially between the upper primary seal metal rib and the lower primary seal metal rib, an upper downwardly angled secondary seal metal rib spaced axially above the upper primary seal metal rib, and a lower upwardly angled secondary seal metal rib spaced axially below the lower primary seal metal rib;

providing a wedge ring having a substantially conical outer surface; and axially moving the annular seal assembly relative to the wedge ring such that the seal assembly is expanded from its run-in position to its expanded position wherein the seal assembly is in sealing engagement with the generally cylindrical interior surface.

19. The method as defined in claim 18, further comprising:

providing an upper biasing member between the upper primary seal metal rib and the upper secondary seal metal rib for exerting a downward biasing force on the upper primary seal metal rib in response to high fluid pressure below the seal assembly; and providing a lower biasing member spaced between the lower primary seal metal rib and the lower secondary seal metal rib for exerting an upward force on the lower primary seal metal rib in response to high fluid pressure above the seal assembly.

20. The method as defined in claim 18, wherein an outer surface of each of the upper primary seal metal rib, the lower primary seal metal rib, the upper secondary seal metal rib, and the lower secondary metal rib is configured for forming an annular metal-to-metal seal with a generally cylindrical interior surface.

21. The method as defined in claim 18, wherein the wedge ring is generally stationary while the seal assembly moves axially with respect to the stationary wedge ring.

22. The method as defined in claim 21, wherein a set down weight transmitted to the seal assembly through the conveyance tubular moves the seal assembly axially with respect to the stationary wedge ring.

23. The method as defined in claim 18, further comprising:

providing one or more axially spaced protrusions on a radially inner surface of the annular base of the metal framework each for metal-to-metal sealing engagement with the conical outer surface of the wedge ring.

24. The method as defined in claim 23, further comprising:

providing one or more annular elastomeric sealing members for sealing between the base of the metal framework and the conical outer surface of the wedge ring.

25. The method as defined in claim 18, further comprising:

providing one or more annular metal protrusions on one of an outer surface of the conveyance tubular and an inner surface of the wedge ring to form a metal-to-metal seal between the wedge ring and the conveyance tubular.

* * * * *

UNITED STATES PATENT AND TRADEMARK OFFICE

CERTIFICATE OF CORRECTION

PATENT NO. : 6,666,276 B1
DATED : December 23, 2003
INVENTOR(S) : John M. Yokley et al.

It is certified that error appears in the above-identified patent and that said Letters Patent is hereby corrected as shown below:

Title page,
Item [73], Assignee, change from "John M. Yokley" to -- Dril-Quip, Inc. --.

Signed and Sealed this

Eleventh Day of May, 2004

JON W. DUDAS
*Acting Director of the United States Patent and Trademark Office*